US011138953B1

(12) United States Patent
Wu

(10) Patent No.: US 11,138,953 B1
(45) Date of Patent: Oct. 5, 2021

(54) METHOD FOR PERFORMING DYNAMIC PEAK BRIGHTNESS CONTROL IN DISPLAY MODULE, AND ASSOCIATED TIMING CONTROLLER

(71) Applicant: HIMAX TECHNOLOGIES LIMITED, Tainan (TW)

(72) Inventor: Tung-Ying Wu, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 0 days.

(21) Appl. No.: 16/878,636

(22) Filed: May 20, 2020

(51) Int. Cl.
*G09G 3/3208* (2016.01)
*G09G 5/10* (2006.01)

(52) U.S. Cl.
CPC ..... *G09G 5/10* (2013.01); *G09G 3/3208* (2013.01); *G09G 2310/08* (2013.01); *G09G 2320/0276* (2013.01); *G09G 2320/0633* (2013.01); *G09G 2320/0646* (2013.01)

(58) Field of Classification Search
None
See application file for complete search history.

(56) References Cited

U.S. PATENT DOCUMENTS

2007/0035707 A1* 2/2007 Margulis ..... H04N 5/7416 353/122
2009/0284544 A1* 11/2009 Nobori ..... G09G 3/3406 345/589
2012/0256936 A1 10/2012 Lee
2019/0197959 A1* 6/2019 Noh ..... G09G 3/3233
2019/0250981 A1* 8/2019 Anand ..... G09G 5/14

FOREIGN PATENT DOCUMENTS

TW I486936 B 6/2015
TW I627624 B 6/2018
TW I637382 B 10/2018

* cited by examiner

*Primary Examiner* — Stephen G Sherman
*Assistant Examiner* — Donna V Bocar
(74) *Attorney, Agent, or Firm* — Winston Hsu

(57) ABSTRACT

A method for performing dynamic peak brightness control in a display module and an associated timing controller are provided. The method includes: calculating a maximum value and a minimum value of a previous image to determine a contrast ratio (CR) of the previous image; calculating a maximum level quantity (MLQ) of the previous image, wherein the MLQ represents a number of pixels corresponding to the maximum value; performing pixel data mapping on original pixel data of a current image according to a first gain corresponding to the MLQ, to generate intermediate pixel data of the current image; and performing selective pixel data adjustment on the intermediate pixel data according to a second gain corresponding to the CR and the MLQ, to generate updated pixel data of the current image, for being displayed on a display panel of the display module, wherein the updated pixel data replaces the original pixel data.

12 Claims, 10 Drawing Sheets

MLQ(%)

| Gain / CR(%) | 0% | 6% | 13% | 19% | 25% | 31% | 38% | 44% | 50% | 56% | 63% | 69% | 75% | 81% | 88% | 94% | 100% |
|---|---|---|---|---|---|---|---|---|---|---|---|---|---|---|---|---|---|
| 0% | 1.00 | 1.00 | 1.00 | 1.00 | 1.00 | 1.00 | 1.00 | 1.00 | 1.00 | 0.98 | 0.95 | 0.93 | 0.90 | 0.88 | 0.85 | 0.83 | 0.80 |
| 7% | 1.00 | 1.00 | 1.00 | 1.00 | 1.00 | 1.00 | 1.00 | 1.00 | 1.00 | 1.00 | 0.98 | 0.96 | 0.94 | 0.91 | 0.89 | 0.87 | 0.85 |
| 13% | 1.00 | 1.00 | 1.00 | 1.00 | 1.00 | 1.00 | 1.00 | 1.00 | 1.00 | 1.00 | 1.00 | 0.98 | 0.97 | 0.95 | 0.93 | 0.92 | 0.90 |
| 20% | 1.00 | 1.00 | 1.00 | 1.00 | 1.00 | 1.00 | 1.00 | 1.00 | 1.00 | 1.00 | 1.00 | 1.00 | 0.99 | 0.98 | 0.97 | 0.96 | 0.95 |
| 27% | 1.00 | 1.00 | 1.00 | 1.00 | 1.00 | 1.00 | 1.00 | 1.00 | 1.00 | 1.00 | 1.00 | 1.00 | 1.00 | 1.00 | 0.99 | 0.99 | 0.98 |
| 33% | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 |
| 40% | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 |
| 47% | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 |
| 53% | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 |
| 60% | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 |
| 67% | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 |
| 73% | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 |
| 80% | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 |
| 87% | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 |
| 93% | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 |
| 100% | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 |

FIG. 5

| Gain / CR(%) | 0% | 6% | 13 % | 19 % | 25 % | 31 % | 38 % | 44 % | 50 % | 56 % | 63 % | 69 % | 75 % | 81 % | 88 % | 94 % | 100 % |
|---|---|---|---|---|---|---|---|---|---|---|---|---|---|---|---|---|---|
| 0% | 1.00 | 1.00 | 1.00 | 1.00 | 1.00 | 1.00 | 1.00 | 1.00 | 1.00 | 0.98 | 0.95 | 0.93 | 0.90 | 0.88 | 0.85 | 0.83 | 0.80 |
| 7% | 1.00 | 1.00 | 1.00 | 1.00 | 1.00 | 1.00 | 1.00 | 1.00 | 1.00 | 1.00 | 0.98 | 0.96 | 0.94 | 0.91 | 0.89 | 0.87 | 0.85 |
| 13% | 1.00 | 1.00 | 1.00 | 1.00 | 1.00 | 1.00 | 1.00 | 1.00 | 1.00 | 1.00 | 1.00 | 0.98 | 0.97 | 0.95 | 0.93 | 0.92 | 0.90 |
| 20% | 1.00 | 1.00 | 1.00 | 1.00 | 1.00 | 1.00 | 1.00 | 1.00 | 1.00 | 1.00 | 1.00 | 1.00 | 0.99 | 0.98 | 0.97 | 0.96 | 0.95 |
| 27% | 1.00 | 1.00 | 1.00 | 1.00 | 1.00 | 1.00 | 1.00 | 1.00 | 1.00 | 1.00 | 1.00 | 1.00 | 1.00 | 1.00 | 0.99 | 0.99 | 0.98 |
| 33% | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 |
| 40% | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 |
| 47% | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 |
| 53% | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 |
| 60% | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 |
| 67% | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 |
| 73% | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 |
| 80% | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 |
| 87% | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 |
| 93% | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 |
| 100% | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 |

METHOD FOR PERFORMING DYNAMIC PEAK BRIGHTNESS CONTROL IN DISPLAY MODULE, AND ASSOCIATED TIMING CONTROLLER

BACKGROUND OF THE INVENTION

1. Field of the Invention

The present invention relates to display control, and more particularly, to a method for performing dynamic peak brightness control in a display module and an associated timing controller.

2. Description of the Prior Art

Display devices such as organic light-emitting diode (OLED) panels have been widely used in electronic devices such as multifunctional mobile phones. According to the related art, a display device of a host system may be arranged to display information for the host system. However, some problems may occur in a situation where the display device is implemented according to OLED technologies. For example, when bright images are frequently displayed, the display device may have a shorter expected lifetime. Hence, there is a need for a novel method and associated architecture to enhance display control regarding bright or partially bright images without introducing a side effect or in a way that is less likely to introduce a side effect.

SUMMARY OF THE INVENTION

It is therefore an objective of the present invention to provide a method for performing dynamic peak brightness control in a display module, and to provide an associated timing controller, in order to solve the above-mentioned problems.

It is another objective of the present invention to provide a method for performing dynamic peak brightness control in a display module, and to provide an associated timing controller, in order to enhance display control regarding bright or partially bright images without introducing a side effect or in a way that less likely to introduce a side effect.

At least one embodiment of the present invention provides a method for performing dynamic peak brightness control in a display module. The method may comprise: calculating a maximum value and a minimum value of a previous image to determine a contrast ratio (CR) of the previous image; calculating a maximum level quantity (MLQ) of the previous image, wherein the MLQ represents a number of pixels corresponding to the maximum value; performing pixel data mapping on original pixel data of a current image according to a first gain corresponding to the MLQ, to generate intermediate pixel data of the current image; and performing selective pixel data adjustment on the intermediate pixel data according to a second gain corresponding to the CR and the MLQ, to generate updated pixel data of the current image, for being displayed on a display panel of the display module, wherein the updated pixel data replaces the original pixel data.

In addition to the above method, the present invention also provides a timing controller, where the timing controller is applicable to performing dynamic peak brightness control in a display module. The timing controller may comprise a brightness distribution estimation circuit, and comprise a pixel data mapping circuit and a selective pixel data adjustment circuit that are coupled to the brightness distribution estimation circuit. The brightness distribution estimation circuit may be arranged to perform brightness distribution estimation by calculating a maximum value and a minimum value of a previous image to determine a contrast ratio (CR) of the previous image and by calculating a maximum level quantity (MLQ) of the previous image, wherein the CR and the MLQ are utilized as brightness distribution estimation results of the brightness distribution estimation, and the MLQ represents a number of pixels corresponding to the maximum value. In addition, the pixel data mapping circuit may be arranged to perform pixel data mapping on original pixel data of a current image according to a first gain corresponding to the MLQ, to generate intermediate pixel data of the current image. Additionally, the selective pixel data adjustment circuit may be arranged to perform selective pixel data adjustment on the intermediate pixel data according to a second gain corresponding to the CR and the MLQ, to generate updated pixel data of the current image, for being displayed on a display panel of the display module, wherein the updated pixel data replaces the original pixel data.

The present invention method and associated apparatus (e.g. the timing controller) can guarantee that any video input carrying bright or partially bright images will not make the display module suffer from a shorter expected lifetime. In addition, implementing the embodiments of the present invention does not significantly increase additional costs. Therefore, the related art problems can be solved, and the overall cost will not increase too much. In comparison with the related art, the present invention method and associated apparatus can enhance display control regarding bright or partially bright images without introducing any side effect or in a way that is less likely to introduce a side effect.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 5 illustrates a two-dimensional (2D) look-up table (LUT) involved with the peak brightness control scheme shown in FIG. 3 according to an embodiment of the present invention.

DETAILED DESCRIPTION

Figure 1:
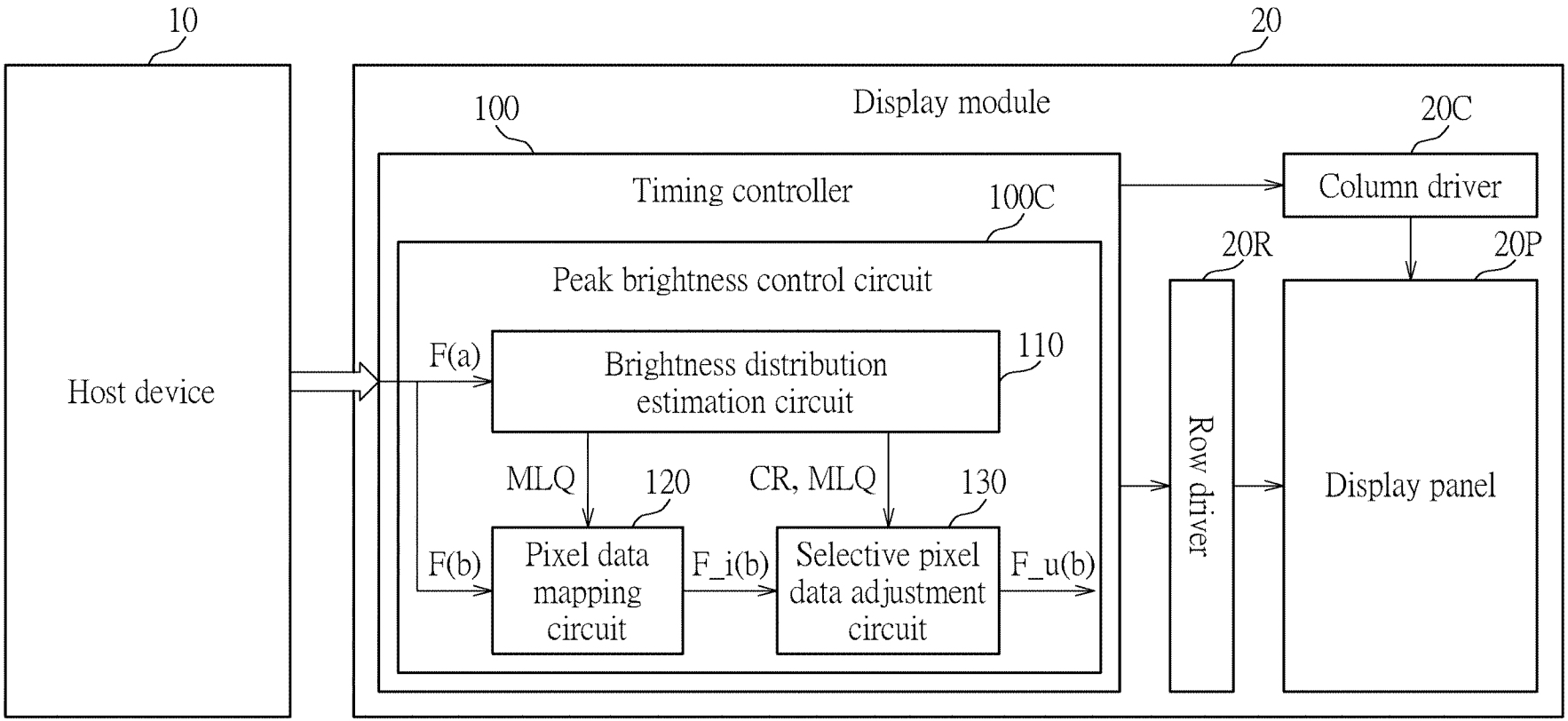
FIG. 1 is a diagram of a host system according to an embodiment of the present invention, where the host system may comprise a host device and a display module.

FIG. 1 is a diagram of a host system according to an embodiment of the present invention, where the host system may comprise a host device 10 and a display module 20, and the display module 20 may comprise a timing controller 100, at least one column driver (e.g. one or more column drivers) which may be collectively referred to as the column driver 20C, at least one row driver (e.g. one or more row drivers) which may be collectively referred to as the row driver 20R, and a display panel 20P. For better comprehension, the host system shown in FIG. 1 may be implemented to be an electronic device such as a multifunctional mobile phone, etc., and the host device 10 may be arranged to control operations of the electronic device, where the display module 20 (e.g. the display panel 20P, etc. thereof) may represent an organic light-emitting diode (OLED) module (e.g. an OLED panel, etc. thereof) implemented according to OLED technologies, but the present invention is not limited thereto. For example, the display module 20 may be one of other types of display modules implemented according to other technologies, and more particularly, the architecture thereof may vary when there is a need. In some embodiments, the host system shown in FIG. 1 may be implemented to be any of some other types of electronic devices.

The timing controller 100 may perform display control (e.g. perform timing control, image enhancement, etc.) on the display panel 20P through the column driver 20C and the row driver 20R, and more particularly, may output associated display control signals to the column driver 20C and the row driver 20R and output video signals to at least one of the column driver 20C and the row driver 20R, for controlling the display panel 20P to display a plurality of images (e.g. image frames) such as {F(0), F(1), F(2), . . . }, but the present invention is not limited thereto. As shown in FIG. 1, the timing controller 100 may comprise a peak brightness control circuit 100C, and the peak brightness control circuit 100C may comprise a brightness distribution estimation circuit 110, and comprise a pixel data mapping circuit 120 and a selective pixel data adjustment circuit 130 that are coupled to the brightness distribution estimation circuit 110, but the present invention is not limited thereto. The timing controller 100 is applicable to performing dynamic peak brightness control in the display module 20, for example, by using the peak brightness control circuit 100C.

Based on the architecture shown in FIG. 1, the timing controller 100 may receive at least one video input such as one or more video input signals carrying a series of image data and associated control signals from the host device 10, for example, through a video input path between the host device 10 and the timing controller 100. For better comprehension, in a situation where the host system shown in FIG. 1 is implemented to be the electronic device such as the multifunctional mobile phone, etc., the video input path may comprise a flexible printed circuit (FPC) between the host device 10 and the display module 20, and comprise an interface circuit conforming to at least one specification, where the interface circuit may be positioned in the display module 20, and more particularly, in the timing controller 100, but the present invention is not limited thereto. According to some embodiments, the host device 10 and the display module 20 may be detachable, and the FPC may be replaced by a transmission cable such as a video input cable.

Figure 2:
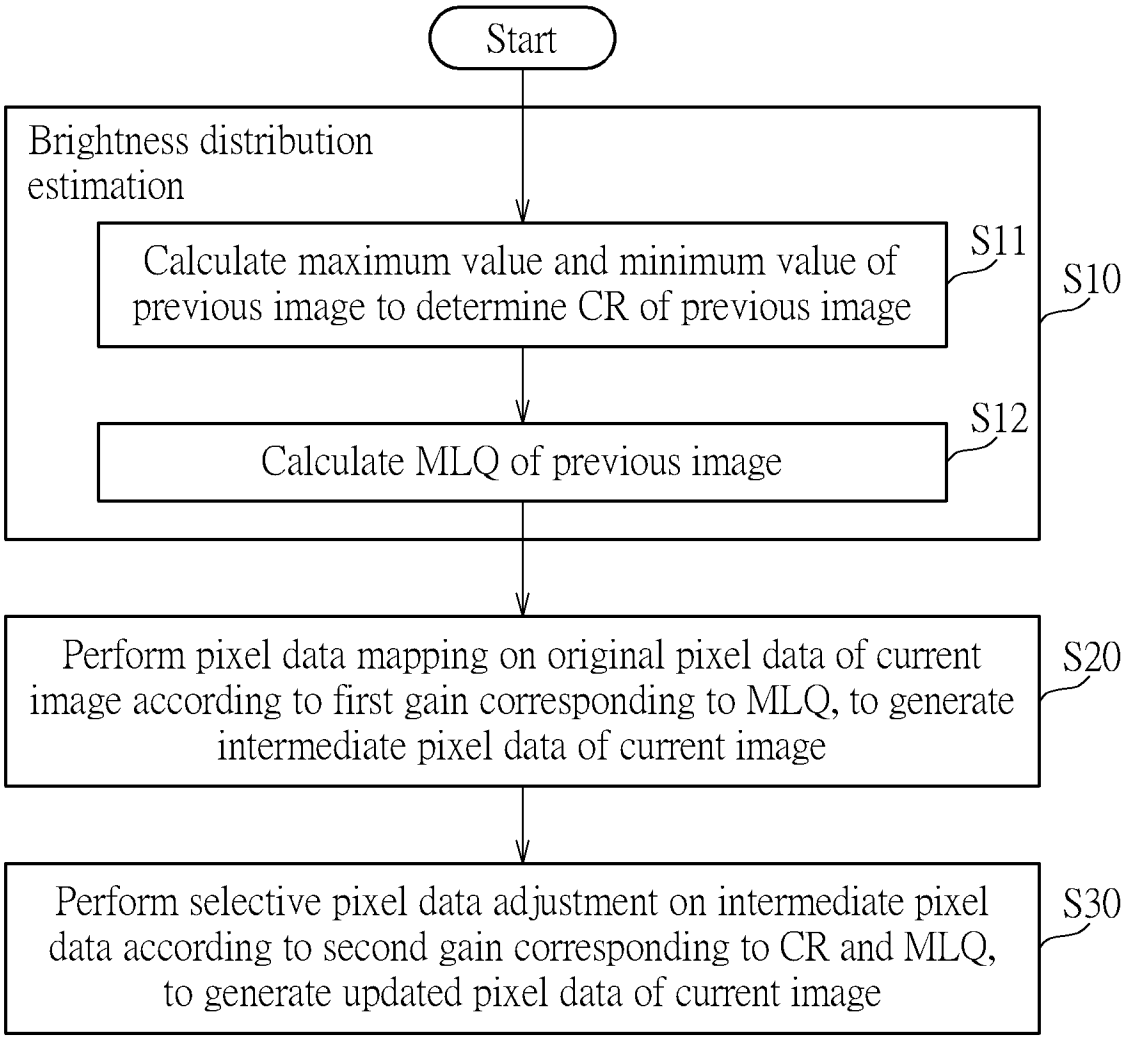
FIG. 2 is a flowchart of a method for performing dynamic peak brightness control in a display module such as the display module shown in FIG. 1 according to an embodiment of the present invention.

FIG. 2 is a flowchart of a method for performing dynamic peak brightness control in a display module such as the display module shown in FIG. 1 according to an embodiment of the present invention. The working flow shown in FIG. 2 may be applied to the timing controller 100 (e.g. the components thereof).

In Step S10, the timing controller 100 (e.g. the brightness distribution estimation circuit 110) may perform brightness distribution estimation, for example, by calculating a maximum value and a minimum value of a previous image F(a) to determine a contrast ratio (CR) of the previous image F(a) and by calculating a maximum level quantity (MLQ) of the previous image F(a), where the CR and the MLQ may be utilized as brightness distribution estimation results of the brightness distribution estimation, but the present invention is not limited thereto. According to this embodiment, Step S10 may comprise some sub-steps such as Steps S11 and S12.

In Steps S11, the timing controller 100 (e.g. the brightness distribution estimation circuit 110) may calculate the maximum value and the minimum value of the previous image F(a) to determine the CR of the previous image F(a) as follows:

$$CR_img=(Max_img-Min_img)/Max_img;$$

where CR_img, Max_img, and Min_img may represent the CR, the maximum value, and the minimum value of the previous image F(a), but the present invention is not limited thereto. For example, the previous image F(a) may be one of the plurality of images {F(0), F(1), F(2), . . . } (e.g. the index "a" of F(a) may be an integer), and the maximum value and the minimum value may represent the maximum pixel value and the minimum pixel value of the previous image F(a), respectively.

In Steps S12, the timing controller 100 (e.g. the brightness distribution estimation circuit 110) may calculate the MLQ of the previous image F(a), where the MLQ may represent a number of pixels corresponding to the maximum value (such as Max_img). For example, the MLQ may represent a number of pixels respectively having pixel values that are equal to the maximum value, and therefore, the MLQ may also be referred to as the maximum value quantity.

According to this embodiment, the brightness distribution estimation circuit 110 may calculate the maximum value and the minimum value of the previous image F(a) according to pixel values corresponding to at least one display channel (e.g. one or more display channels) of a plurality of display channels within the previous image F(a), to determine the CR of the previous image F(a), where the plurality of display channels may comprise red (R), green (G), and blue (B) display channels, but the present invention is not limited thereto. For example, the aforementioned at least one display channel may represent any display channel of the plurality of display channels (e.g. one of the R, G, and B display channels), and the maximum value and the minimum value may represent a maximum and a minimum of multiple pixel values corresponding to this display channel, respectively. For another example, the aforementioned at least one display channel may represent all of the plurality of display channels (e.g. all of the R, G, and B display channels), and the maximum value and the minimum value may represent a maximum and a minimum of multiple pixel values corresponding to all of the plurality of display channels, respectively.

For better comprehension, a set of gray levels (GLs) GL_R, GL_G, and GL_B respectively corresponding to the R, G, and B display channels may be used for describing the pixel values of any pixel in any image of the plurality of images {F(0), F(1), F(2), . . . } in the format (GL_R, GL_G, GL_B), where any GL of the set of GLs GL_R, GL_G, and GL_B may be an integer within an interval [0, 255], but the present invention is not limited thereto. Assume that a parameter such as PIXEL_COUNT_PER_IMAGE may represent a pixel count per image. For the case that the aforementioned at least one display channel represents the aforementioned any display channel such as the one of the R, G, and B display channels, when this image is pure red, (GL_R, GL_G, GL_B)=(255, 0, 0) for each pixel thereof, and therefore, CR_img=(255−0)/255=1 and MLQ=PIXEL_COUNT_PER_IMAGE; when this image is pure green, (GL_R, GL_G, GL_B)=(0, 255, 0) for each pixel thereof, and therefore, CR_img=(255−0)/255=1 and MLQ=PIXEL_COUNT_PER_IMAGE; when this image is pure blue, (GL_R, GL_G, GL_B)=(0, 0, 255) for each pixel thereof, and therefore, CR_img=(255−0)/255=1 and MLQ=PIXEL_COUNT_PER_IMAGE; and when this image is pure white, (GL_R, GL_G, GL_B)=(255, 255, 255) for each pixel thereof, and therefore, CR_img=(255−0)/255=1 and MLQ=PIXEL_COUNT_PER_IMAGE. For the case that the aforementioned at least one display channel represents all of the plurality of display channels, such as all of the R, G, and B display channels, when this image is pure white, (GL_R, GL_G, GL_B)=(255, 255, 255) for each pixel thereof, and therefore, CR_img=(255−0)/255=1 and MLQ=PIXEL_COUNT_PER_IMAGE.

In Step S20, the timing controller 100 (e.g. the pixel data mapping circuit 120) may perform pixel data mapping on original pixel data of a current image F(b) according to a first gain G1(b) corresponding to the MLQ, to generate intermediate pixel data of the current image F(b), such as pixel data of an intermediate image F_i(b). For example, the current image F(b) may be another of the plurality of images {F(0), F(1), F(2), . . . } (e.g. the index "b" of F(b) may be an integer), such as a subsequent image of the previous image F(a) within the plurality of images {F(0), F(1), F(2), . . . }, where b>a.

In Step S30, the timing controller 100 (e.g. the selective pixel data adjustment circuit 130) may perform selective pixel data adjustment on the intermediate pixel data (such as pixel data of the intermediate image F_i(b)) according to a second gain G2(b) corresponding to the CR and the MLQ, to generate updated pixel data of the current image F(b), such as pixel data of an updated image F_u(b), for being displayed on the display panel 20P of the display module 20, where the updated pixel data such as the pixel data of the updated image F_u(b) replaces the original pixel data of the current image F(b).

For better comprehension, the method may be illustrated with the working flow shown in FIG. 2, but the present invention is not limited thereto. According to some embodiments, one or more steps may be added, deleted, or changed in the working flow shown in FIG. 2.

In addition, the brightness distribution estimation circuit 110 may be arranged to transmit the MLQ to the pixel data mapping circuit 120 and the selective pixel data adjustment circuit 130, but the present invention is not limited thereto. For example, the MLQ may be expressed with an MLQ-related parameter corresponding to the MLQ (e.g. a ratio of the MLQ to the pixel count per image PIXEL_COUNT_PER_IMAGE) as follows:

$$MLQ\ (\%)=(MLQ/PIXEL_COUNT_PER_IMAGE);$$

where the parameters MLQ (%) and MLQ may represent the MLQ-related parameter and the MLQ, respectively. Therefore, the brightness distribution estimation circuit 110 may be arranged to transmit the MLQ-related parameter corresponding to the MLQ, such as the parameter MLQ (%) of the MLQ, to the pixel data mapping circuit 120 and the selective pixel data adjustment circuit 130. Similarly, the CR may be expressed with a parameter CR (%) of the CR, and the brightness distribution estimation circuit 110 may be arranged to transmit the parameter CR (%) of the CR to the selective pixel data adjustment circuit 130.

Additionally, the aforementioned any GL of the set of GLs GL_R, GL_G, and GL_B may be an integer within a predetermined interval such as the interval [0, 255] (e.g. $2^8-1=255$), but the present invention is not limited thereto. According to some embodiments, the predetermined interval may vary, and more particularly, may become greater or smaller. For example, the predetermined interval may be any of a series of intervals [0, $2^9-1$], [0, $2^{10}-1$], [0, $2^{11}-1$], [0, $2^{12}-1$], etc. or any of some other intervals when there is a need.

Figure 3:
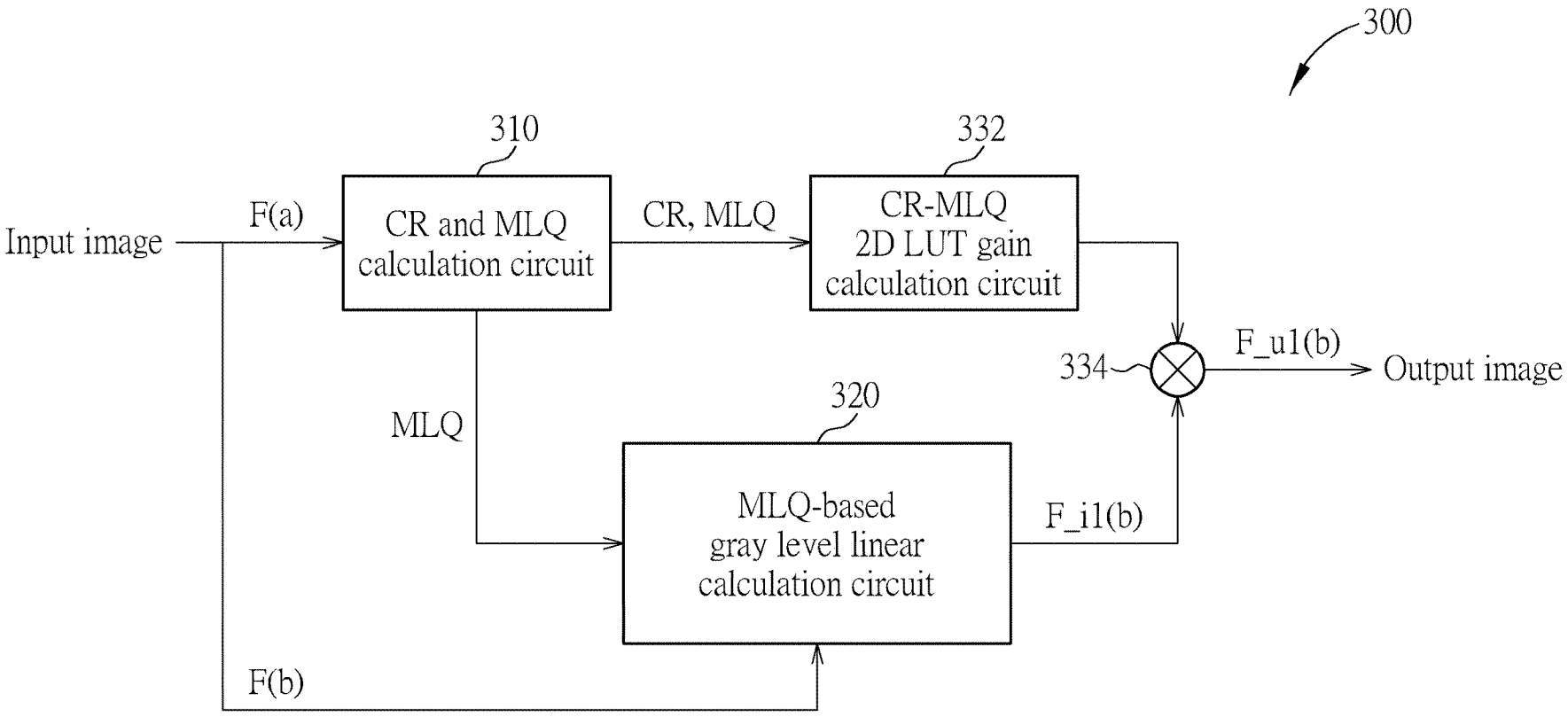
FIG. 3 illustrates a peak brightness control scheme of the method shown in FIG. 2 according to an embodiment of the present invention.

FIG. 3 illustrates a peak brightness control scheme of the method shown in FIG. 2 according to an embodiment of the present invention, where the peak brightness control circuit 300 may be taken as an example of the peak brightness control circuit 100C. The peak brightness control circuit 300 may comprise a CR and MLQ calculation circuit 310, an MLQ-based gray level linear calculation circuit 320, a CR-MLQ two-dimensional (2D) look-up table (LUT) gain calculation circuit 332, and a gain adjustment unit 334 (e.g. an amplifier), and may receive and process input images (e.g. the plurality of images {F(0), F(1), F(2), . . . }) to generate output images (e.g. an updated version of the plurality of images {F(0), F(1), F(2), . . . }, such as updated images {F_u(0), F_u(1), F_u(2), . . . }). For better comprehension, a combination of the CR-MLQ 2D LUT gain calculation circuit 332 and the gain adjustment unit 334 may be taken as an example of the selective pixel data adjustment circuit 130, and an intermediate image F_i1(b) input into the gain adjustment unit 334 and an updated image F_u1(b) output from the gain adjustment unit 334 may be taken as examples of the intermediate image F_i(b) and the updated image F_u(b), respectively.

According to this embodiment, the brightness distribution estimation circuit 110 such as the CR and MLQ calculation circuit 310 may calculate the CR and the MLQ of the previous image F(a). In addition, the pixel data mapping circuit 120 such as the MLQ-based gray level linear calculation circuit 320 may perform the pixel data mapping on the original pixel data according to a mapping curve corresponding to the MLQ, to generate the intermediate pixel data, where the mapping curve may be related to the first gain G1(b). For example, the mapping curve may represent a predetermined mapping curve corresponding to a first possible value of the MLQ. For another example, the mapping curve may represent an intermediate mapping curve between two predetermined mapping curves respectively corresponding to the first possible value and a second possible value of the MLQ, and the timing controller 100 (e.g. the pixel data mapping circuit 120 such as the MLQ-based gray level linear calculation circuit 320) may perform gain value interpolation according to the two predetermined mapping curves, to generate the intermediate mapping curve to be the mapping curve corresponding to the MLQ, where the two predetermined mapping curves may comprise the predetermined mapping curve. Additionally, the selective pixel data adjustment circuit 130 (e.g. the CR-MLQ 2D LUT gain calculation circuit 332 in this embodiment) may look up a 2D LUT according to the CR and the MLQ, to obtain a candidate gain value corresponding to the CR and the MLQ from the 2D LUT to be the second gain G2(b), where the 2D LUT may comprise a 2D array of candidate gain values respectively corresponding to multiple possible values of the CR and multiple possible values of the MLQ, and the selective pixel data adjustment circuit 130 (e.g. the gain adjustment unit 334 in this embodiment) may apply the second gain G2(b) to the intermediate pixel data to generate the updated pixel data. For brevity, similar descriptions for this embodiment are not repeated in detail here.

Please note that the CR and MLQ calculation circuit 310 may be arranged to transmit the MLQ to the MLQ-based gray level linear calculation circuit 320 and the CR-MLQ 2D LUT gain calculation circuit 332 and transmit the CR to the CR-MLQ 2D LUT gain calculation circuit 332, but the present invention is not limited thereto. For example, the CR and MLQ calculation circuit 310 may be arranged to transmit the parameter MLQ (%) to the MLQ-based gray level linear calculation circuit 320 and the CR-MLQ 2D LUT gain calculation circuit 332 and transmit the parameter CR (%) to the CR-MLQ 2D LUT gain calculation circuit 332. For brevity, similar descriptions for these embodiments are not repeated in detail here.

Figure 4:
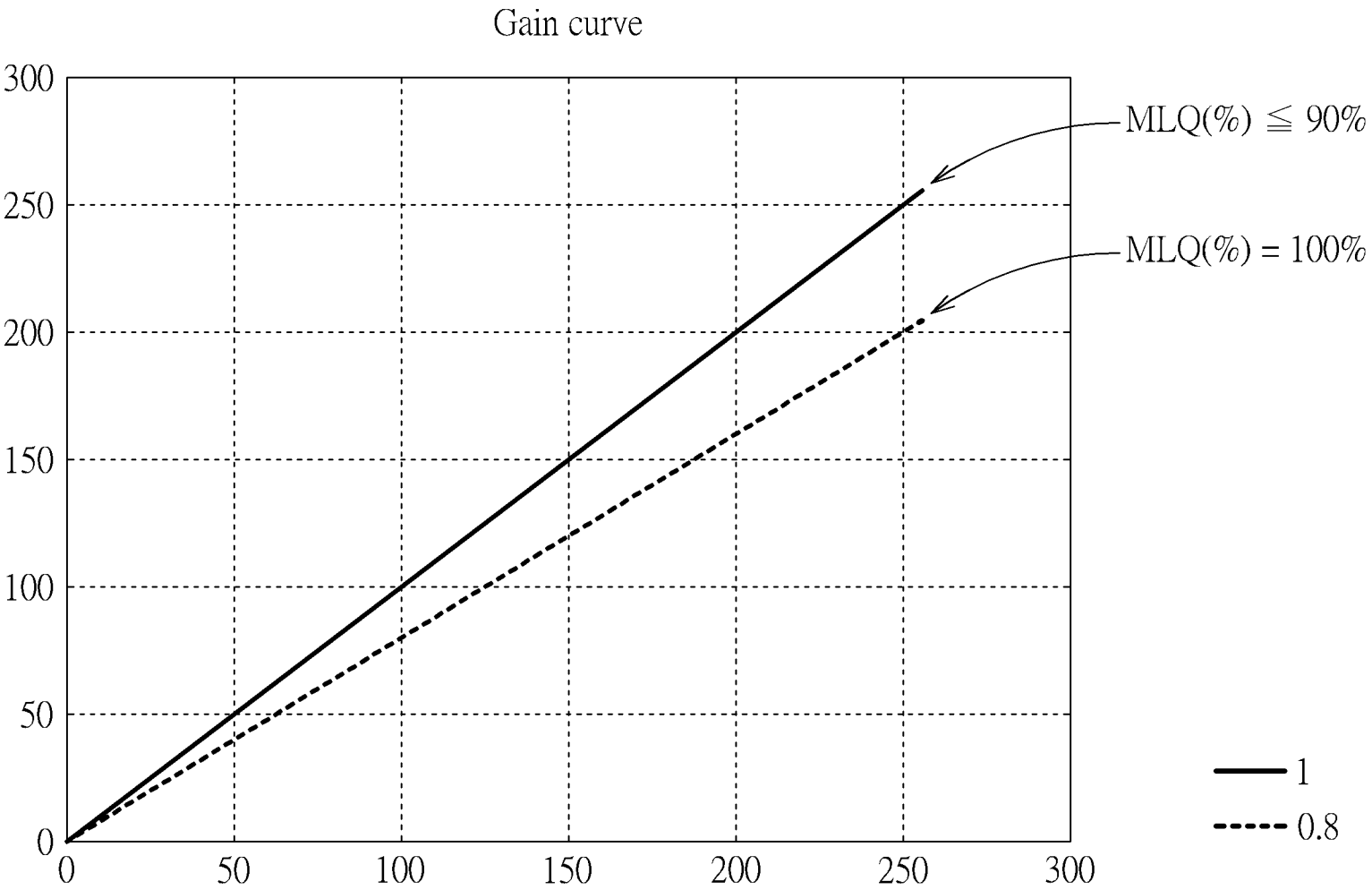
FIG. 4 illustrates some mapping relationships involved with the peak brightness control scheme shown in FIG. 3 according to an embodiment of the present invention.

FIG. 4 illustrates some mapping relationships involved with the peak brightness control scheme shown in FIG. 3 according to an embodiment of the present invention. The two gain curves shown in FIG. 4 may be taken as examples of the two predetermined mapping curves, where the upper gain curve (e.g. a line segment having two end points (0, 0) and (255, 255)) and the lower gain curve (e.g. a line segment having two end points (0, 0) and (255, 204)) of these two gain curves may be related to G1(b)=1 and G1(b)=0.8, respectively. For example, when MLQ (%)≤90%, the pixel data mapping circuit 120 such as the MLQ-based gray level linear calculation circuit 320 may utilize the upper gain curve as the mapping curve corresponding to the MLQ. For another example, when MLQ (%)=100%, the pixel data mapping circuit 120 such as the MLQ-based gray level linear calculation circuit 320 may utilize the lower gain curve as the mapping curve corresponding to the MLQ.

In addition, the pixel data mapping circuit 120 such as the MLQ-based gray level linear calculation circuit 320 may utilize an intermediate gain curve between these two gain curves as the intermediate mapping curve, to be the mapping curve corresponding to the MLQ. For example, when MLQ (%)=95%, the pixel data mapping circuit 120 such as the MLQ-based gray level linear calculation circuit 320 may utilize an average curve of these two gain curves (e.g. a line segment having two end points (0, 0) and (255, 229.5)) as the mapping curve corresponding to the MLQ, where this average curve may be related to G1(b)=0.9. For another example, when MLQ (%)=92.5%, the pixel data mapping circuit 120 such as the MLQ-based gray level linear calculation circuit 320 may utilize a weighted average curve of these two gain curves (e.g. a line segment having two end points (0, 0) and (255, 242.25)) as the mapping curve corresponding to the MLQ, where this weighted average curve may be related to G1(b)=0.95. For yet another example, when MLQ (%)=97.5%, the pixel data mapping circuit 120 such as the MLQ-based gray level linear calculation circuit 320 may utilize another weighted average curve of these two gain curves (e.g. a line segment having two end points (0, 0) and (255, 216.75)) as the mapping curve corresponding to the MLQ, where this weighted average curve may be related to G1(b)=0.85. For brevity, similar descriptions for this embodiment are not repeated in detail here.

According to some embodiments, the pixel data mapping circuit 120 such as the MLQ-based gray level linear calculation circuit 320 may perform linear interpolation according to respective mapping results of these two gain curves, to generate the same mapping result as that of the intermediate gain curve (e.g. the average curve, the weighted average curve, and the other weighted average curve). For brevity, similar descriptions for these embodiments are not repeated in detail here.

FIG. 5 illustrates a 2D LUT involved with the peak brightness control scheme shown in FIG. 3 according to an embodiment of the present invention. The 2D LUT shown in FIG. 5 may be taken as an example of the 2D LUT mentioned above. The horizontal index and the vertical index of this 2D LUT may be the parameters MLQ (%) and CR (%), respectively, but the present invention is not limited thereto. For example, the horizontal index may be replaced with the parameter MLQ. As shown in the upper right portion of FIG. 5, a target adjustment region indicated by a closed curve illustrated with dashed lines may correspond to candidate gain values that are less than one. For example, regarding the target adjustment region, when the horizontal index such as the parameter MLQ (%) increases along the rightward direction, the second gain G2(b) decreases. For another example, regarding the target adjustment region, when the vertical index such as the parameter CR (%) decreases along the upward direction, the second gain G2(b) decreases. For brevity, similar descriptions for this embodiment are not repeated in detail here.

Figure 6:
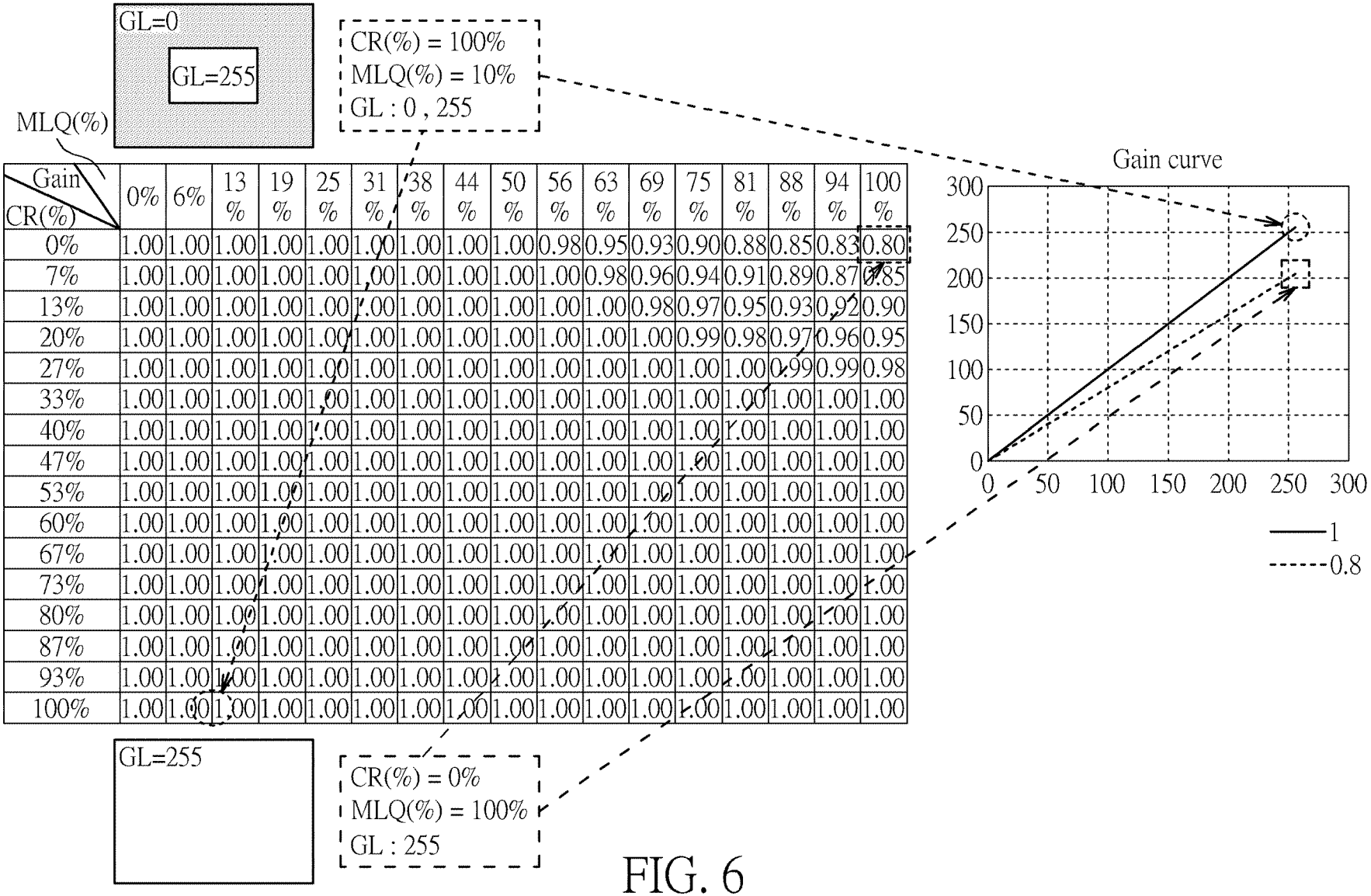
FIG. 6 illustrates some operations of the peak brightness control scheme shown in FIG. 3 according to an embodiment of the present invention.

FIG. 6 illustrates some operations of the peak brightness control scheme shown in FIG. 3 according to an embodiment of the present invention. For example, as shown in the upper left of FIG. 6, when the intermediate image F_i(b) has a black background and a white object (labeled "GL=0" and "GL=255"), and more particularly, CR (%)=100% and MLQ (%)=10%, the pixel data mapping circuit 120 such as the MLQ-based gray level linear calculation circuit 320 may utilize the upper gain curve shown in FIG. 4 as the mapping curve corresponding to the MLQ, and the selective pixel data adjustment circuit 130 (e.g. the CR-MLQ 2D LUT gain calculation circuit 332) may look up the 2D LUT shown in FIG. 5 according to the vertical index such as the parameter CR (%) and the horizontal index such as the parameter MLQ (%), to obtain a candidate gain value 1.00 (e.g. an interpolated candidate gain value obtained from performing interpolation according to two candidate gain values {1.00, 1.00} respectively corresponding to (CR (%)=100%, MLQ (%)=6%) and (CR (%)=100%, MLQ (%)=13%)) from the 2D LUT to be the second gain G2(b).

For another example, as shown in the lower left of FIG. 6, when the intermediate image F_i(b) is pure white (labeled "GL=255"), and more particularly, CR (%)=0% and MLQ (%)=100%, the pixel data mapping circuit 120 such as the MLQ-based gray level linear calculation circuit 320 may utilize the lower gain curve shown in FIG. 4 as the mapping curve corresponding to the MLQ, and the selective pixel data adjustment circuit 130 (e.g. the CR-MLQ 2D LUT gain calculation circuit 332) may look up the 2D LUT shown in FIG. 5 according to the vertical index such as the parameter CR (%) and the horizontal index such as the parameter MLQ (%), to obtain a candidate gain value 0.8 corresponding to (CR (%)=0%, MLQ (%)=100%) from the 2D LUT to be the second gain G2(b). For brevity, similar descriptions for this embodiment are not repeated in detail here.

Figure 7:
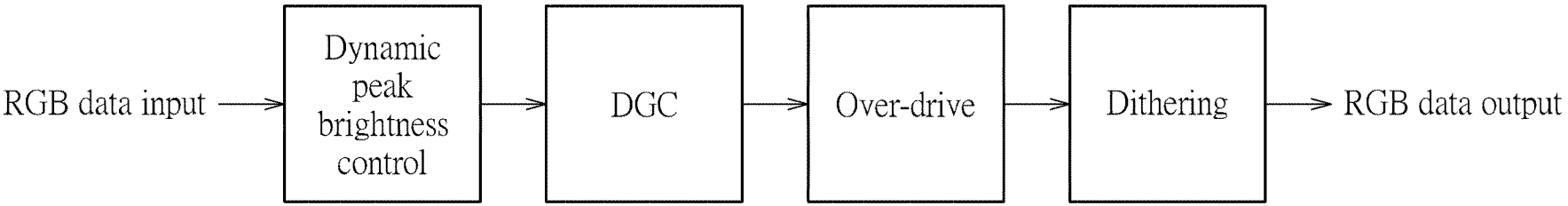
FIG. 7 illustrates a display control scheme of the method shown in FIG. 2 according to an embodiment of the present invention.

FIG. 7 illustrates a display control scheme of the method shown in FIG. 2 according to an embodiment of the present invention. For example, the timing controller 100 may comprise an image processing pipeline comprising multiple pipeline modules, for processing an R-G-B (RGB) data input to generate an RGB data output, and the multiple pipeline modules may comprise a dynamic peak brightness control module (e.g. the peak brightness control circuit 100C such as the peak brightness control circuit 300), a digital gamma correction (DGC) module such as a DGC circuit, an over-drive (OD) module such as a OD circuit, and a dithering module such as a dithering circuit (respectively labeled "Dynamic peak brightness control", "DGC", "Over-drive", and "Dithering" in FIG. 7 for brevity), arranged to perform dynamic peak brightness control, DGC, OD, and dithering operations, respectively. For brevity, similar descriptions for this embodiment are not repeated in detail here.

Figure 8:
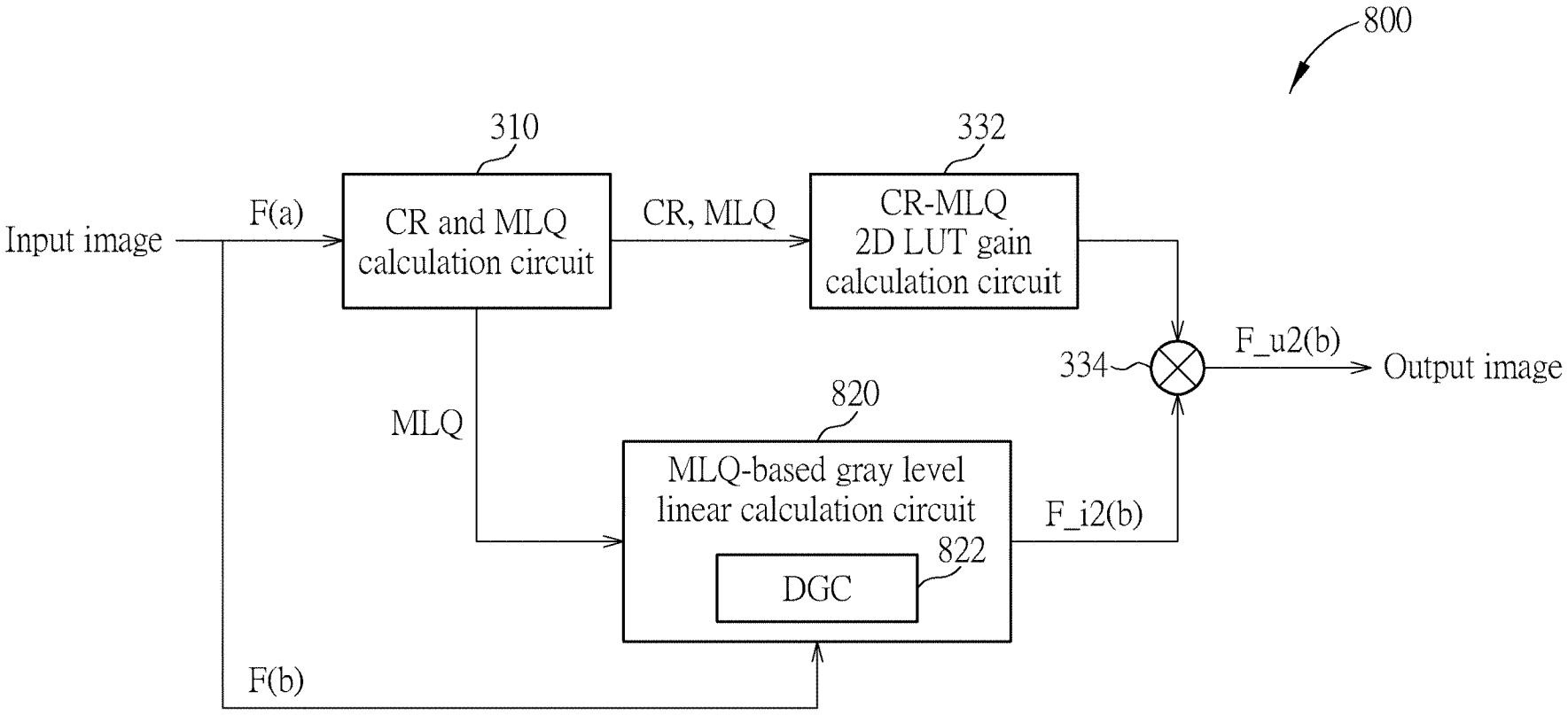
FIG. 8 illustrates a peak brightness control scheme of the method shown in FIG. 2 according to another embodiment of the present invention.

FIG. 8 illustrates a peak brightness control scheme of the method shown in FIG. 2 according to another embodiment of the present invention, where the peak brightness control circuit 800 may be taken as an example of the peak brightness control circuit 100C. In comparison with the architecture shown in FIG. 3, the peak brightness control circuit 800 may comprise an MLQ-based gray level linear calculation circuit 820 that replaces the MLQ-based gray level linear calculation circuit 320. For example, the DGC module in the architecture shown in FIG. 7 and the MLQ-based gray level linear calculation circuit 320 may be integrated into the same module such as the MLQ-based gray level linear calculation circuit 820 comprising a DGC circuit 822 (labeled "DGC" in FIG. 8 for brevity), where the DGC circuit 822 may correspond to the DGC module, and more particularly, may have the same function as that of the DGC module. In response to the change in the architecture, the intermediate image F_i1(b) and the updated image F_u1(b) may be replaced by an intermediate image F_i2(b) and an updated image F_u2(b), respectively. According to this embodiment, the DGC circuit 822 may be arranged to perform one or more DGC operations on the intermediate pixel data first, to make the selective pixel data adjustment circuit such as the MLQ-based gray level linear calculation circuit 820 perform the selective pixel data adjustment on the gamma-corrected data (e.g. the intermediate pixel data that has been gamma-corrected with the one or more DGC operations) according to the second gain to generate the updated pixel data of the current image. For brevity, similar descriptions for this embodiment are not repeated in detail here.

Please note that the CR and MLQ calculation circuit 310 may be arranged to transmit the MLQ to the MLQ-based gray level linear calculation circuit 820 and the CR-MLQ 2D LUT gain calculation circuit 332 and transmit the CR to the CR-MLQ 2D LUT gain calculation circuit 332, but the present invention is not limited thereto. For example, the CR and MLQ calculation circuit 310 may be arranged to transmit the parameter MLQ (%) to the MLQ-based gray level linear calculation circuit 820 and the CR-MLQ 2D LUT gain calculation circuit 332 and transmit the parameter CR (%) to the CR-MLQ 2D LUT gain calculation circuit 332. For brevity, similar descriptions for these embodiments are not repeated in detail here.

Figure 9:
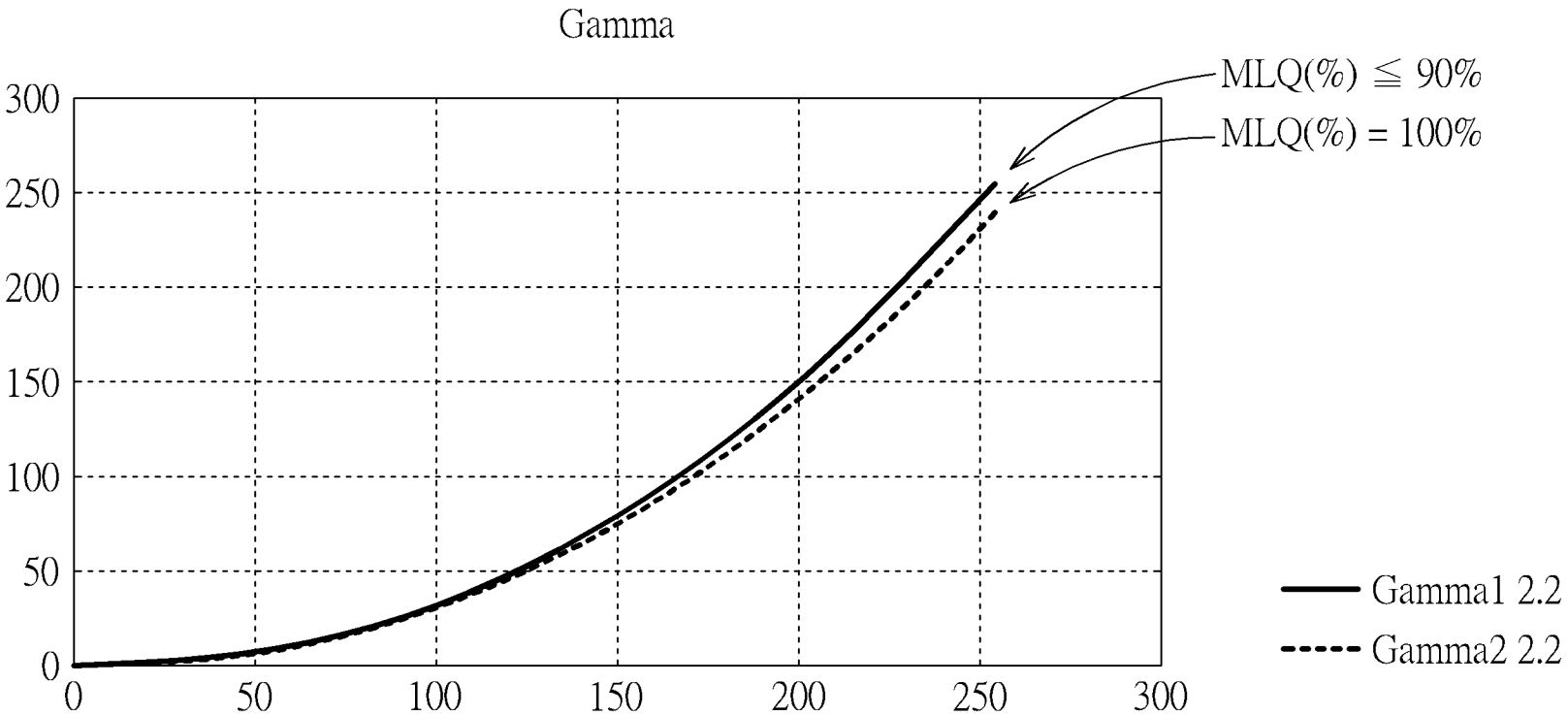
FIG. 9 illustrates some mapping relationships involved with the peak brightness control scheme shown in FIG. 8 according to an embodiment of the present invention.

FIG. 9 illustrates some mapping relationships involved with the peak brightness control scheme shown in FIG. 8 according to an embodiment of the present invention. In response to the change in the architecture, the associated mapping curves (e.g. the two predetermined mapping curves, the intermediate mapping curve, etc.) may be changed from gain curves to gamma curves. For example, the upper gain curve and the lower gain curve shown in FIG. 4 may be replaced by the upper gamma curve and the lower gamma curve shown in FIG. 9, respectively, where the legend of "Gamma1 2.2" and "Gamma2 2.2" may indicate that the two gamma curves correspond to the same Gamma value (e.g. Gamma=2.2), and the upper gamma curve (e.g. a gamma curve having two end points (0, 0) and (255, 255)) and the lower gamma curve (e.g. a gamma curve having two end points (0, 0) and (255, 235)) may be related to G1(b)=1 and G1(b)=0.8, respectively, but the present invention is not limited thereto.

In addition, the intermediate mapping curve such as the line segment having two end points (0, 0) and (255, 229.5) regarding MLQ (%)=95%, the line segment having two end points (0, 0) and (255, 242.25) regarding MLQ (%)=92.5%, and the line segment having two end points (0, 0) and (255, 216.75) regarding MLQ (%)=97.5% mentioned in the embodiment shown in FIG. 4 may be replaced by the corresponding interpolated gamma curves, respectively. For example, when MLQ (%)=95%, the pixel data mapping circuit 120 such as the MLQ-based gray level linear calculation circuit 820 may utilize an average curve of these two gamma curves (e.g. a gamma curve having two end points (0, 0) and (255, 245)) as the mapping curve corresponding to the MLQ, where this average curve may be related to G1(b)=0.9. For another example, when MLQ (%)=92.5%, the pixel data mapping circuit 120 such as the MLQ-based gray level linear calculation circuit 820 may utilize a weighted average curve of these two gamma curves (e.g. a gamma curve having two end points (0, 0) and (255, 250)) as the mapping curve corresponding to the MLQ, where this weighted average curve may be related to G1(b)=0.95. For yet another example, when MLQ (%)=97.5%, the pixel data mapping circuit 120 such as the MLQ-based gray level linear calculation circuit 820 may utilize another weighted average curve of these two gamma curves (e.g. a gamma curve having two end points (0, 0) and (255, 240)) as the mapping curve corresponding to the MLQ, where this weighted average curve may be related to G1(b)=0.85. For brevity, similar descriptions for this embodiment are not repeated in detail here.

Figure 10:
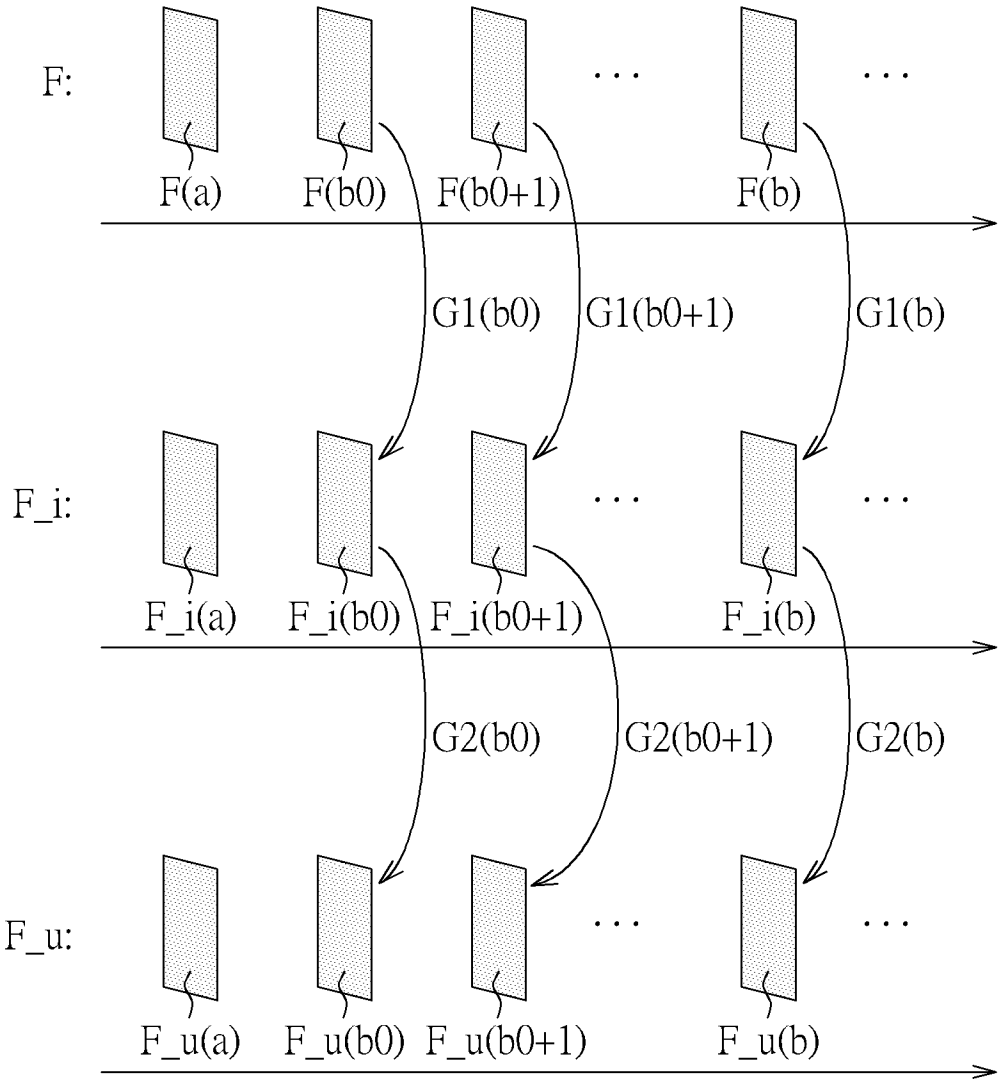
FIG. 10 illustrates a pixel data mapping control scheme of the method shown in FIG. 2 according to an embodiment of the present invention.

FIG. 10 illustrates a pixel data mapping control scheme of the method shown in FIG. 2 according to an embodiment of the present invention, where any gain of the first and the second gains {G1(b), G2(b)} may be less than or equal to one (e.g. G1(b)≤1 and G2(b)≤1). More particularly, the pixel data mapping circuit 120 may perform the pixel data mapping on respective original pixel data of a series of images {F(b0), F(b0+1), . . . , F(b)} within the plurality of images {F(0), F(1), F(2), . . . } (e.g. the index "b0" of F(b0) may be an integer) according to a series of first gains {G1(b0), G1(b0+1), . . . , G1(b)} corresponding to the MLQ, to generate respective intermediate pixel data of the series of images {F(b0), F(b0+1), . . . , F(b)}, such as respective pixel data of a series of intermediate images {F_i(b0), F_i(b0+1), F_i(b)}, where the series of images {F(b0), F(b0+1), . . . , F(b)} may comprise the current image F(b), and a<b0<b. For example, in a situation where 1≥G1(b0)> G1(b0+1)> . . . >G1(b), the pixel data mapping circuit 120 may gradually adjust (e.g. decrease) the brightness of the series of images {F(b0), F(b0+1), . . . , F(b)} during performing the pixel data mapping on the respective original pixel data of the series of images {F(b0), F(b0+1), . . . , F(b)}. For better comprehension, the series of images {F(b0), F(b0+1), . . . , F(b)} may comprise two or more subsequent images staring from the next image of the previous image F(a), where b0=a+1 and b≥(a+2), but the present invention is not limited thereto. In addition, the selective pixel data adjustment circuit 130 may perform the selective pixel data adjustment on the respective intermediate pixel data (such as the respective pixel data of the series of intermediate images {F_i(b0), F_i(b0+1), . . . , F_i(b)}) according to a series of second gains {G2(b0), G2(b0+1), . . . , G2(b)} corresponding to the CR and the MLQ, to generate respective updated pixel data of the series of images {F(b0), F(b0+1), . . . , F(b)}, such as respective pixel data of a series of updated images {F_u(b0), F_u(b0+1), F_u(b)}, for being displayed on the display panel 20P of the display module 20, where the respective updated pixel data such as the respective pixel data of the series of updated images {F_u(b0), F_u(b0+1), F_u(b)} replaces the respective original pixel data of the series of images {F(b0), F(b0+1), . . . , F(b)}. For example, in a situation where 1≥G2(b0)>G2(b0+1)> . . . >G2(b), the selective pixel data adjustment circuit 130 may gradually adjust (e.g. decrease) the brightness of the series of intermediate images {F_i(b0), F_i(b0+1), . . . , F_i(b)} during performing the selective pixel data adjustment on the respective intermediate pixel data such as the pixel data of the series of intermediate images {F_i(b0), F_i(b0+1), . . . , F_i(b)}. As shown in FIG. 10, the intermediate image F_i(a) prior to the series of intermediate images {F_i(b0), F_i(b0+1), F_i(b)} and the updated image F_u(a) prior to the series of updated images {F_u(b0), F_u(b0+1), F_u(b)} may be illustrated for better comprehension, but the present invention is not limited thereto. For brevity, similar descriptions for these embodiments are not repeated in detail here.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A timing controller, applicable to performing dynamic peak brightness control in a display module, the timing controller comprising:

a brightness distribution estimation circuit, arranged to perform brightness distribution estimation by calculating a maximum value and a minimum value of a previous image to determine a contrast ratio (CR) of the previous image and by calculating a maximum level quantity (MLQ) of the previous image, wherein the CR and the MLQ are utilized as brightness distribution estimation results of the brightness distribution estimation, and the MLQ represents a number of pixels corresponding to the maximum value;

a pixel data mapping circuit, coupled to the brightness distribution estimation circuit, arranged to perform pixel data mapping on original pixel data of a current image according to a first gain corresponding to the MLQ, to generate intermediate pixel data of the current image; and a selective pixel data adjustment circuit, coupled to the brightness distribution estimation circuit, arranged to perform selective pixel data adjustment on the intermediate pixel data according to a second gain corresponding to the CR and the MLQ, to generate updated pixel data of the current image, for being displayed on a display panel of the display module, wherein the updated pixel data replaces the original pixel data.

2. The timing controller of claim 1, wherein the brightness distribution estimation circuit calculates the maximum value and the minimum value of the previous image according to pixel values corresponding to at least one display channel of a plurality of display channels within the previous image, to determine the CR of the previous image.

3. The timing controller of claim 2, wherein said at least one display channel represents any display channel of the plurality of display channels, and the maximum value and the minimum value represent a maximum and a minimum of multiple pixel values corresponding to said any display channel, respectively.

4. The timing controller of claim 2, wherein said at least one display channel represents all of the plurality of display channels, and the maximum value and the minimum value represent a maximum and a minimum of multiple pixel values corresponding to all of the plurality of display channels, respectively.

5. The timing controller of claim 1, wherein the pixel data mapping circuit performs the pixel data mapping on the original pixel data according to a mapping curve corresponding to the MLQ, to generate the intermediate pixel data, wherein the mapping curve is related to the first gain.

6. The timing controller of claim 5, wherein the mapping curve represents a predetermined mapping curve corresponding to a first possible value of the MLQ.

7. The timing controller of claim 5, wherein the mapping curve represents an intermediate mapping curve between two predetermined mapping curves respectively corresponding to a first possible value and a second possible value of the MLQ; and the timing controller performs gain value interpolation according to the two predetermined mapping curves, to generate the intermediate mapping curve to be the mapping curve corresponding to the MLQ.

8. The timing controller of claim 1, wherein the selective pixel data adjustment circuit looks up a two-dimensional (2D) look-up table (LUT) according to the CR and the MLQ, to obtain a candidate gain value corresponding to the CR and the MLQ from the 2D LUT to be the second gain, wherein the 2D LUT comprises a 2D array of candidate gain values respectively corresponding to multiple possible values of the CR and multiple possible values of the MLQ; and the selective pixel data adjustment circuit applies the second gain to the intermediate pixel data to generate the updated pixel data.

9. The timing controller of claim 1, wherein any gain of the first and the second gains is less than or equal to one.

10. The timing controller of claim 1, wherein the pixel data mapping circuit performs the pixel data mapping on respective original pixel data of a series of images according to a series of first gains corresponding to the MLQ, to generate respective intermediate pixel data of the series of images, wherein the series of images comprise the current image; and the selective pixel data adjustment circuit performs the selective pixel data adjustment on the respective intermediate pixel data according to a series of second gains corresponding to the CR and the MLQ, to generate respective updated pixel data of the series of images, for being displayed on the display panel of the display module, wherein the respective updated pixel data replaces the respective original pixel data.

11. The timing controller of claim 1, wherein a peak brightness control circuit within the timing controller comprises the brightness distribution estimation circuit, the pixel data mapping circuit, and the selective pixel data adjustment circuit; and the timing controller further comprises:

a digital gamma correction (DGC) circuit, coupled to the peak brightness control circuit, arranged to perform one or more DGC operations;

an over-drive (OD) circuit, coupled to the DGC) circuit, arranged to perform one or more OD operations; and a dithering circuit, coupled to the OD circuit, arranged to perform one or more dithering operations.

12. The timing controller of claim 1, wherein the pixel data mapping circuit comprises:

a digital gamma correction (DGC) circuit, arranged to perform one or more DGC operations on the intermediate pixel data first, to make the selective pixel data adjustment circuit perform the selective pixel data adjustment on the intermediate pixel data that has been gamma-corrected with the one or more DGC operations according to the second gain to generate the updated pixel data of the current image.

* * * * *